US008244411B2

(12) United States Patent
Baker

(10) Patent No.: US 8,244,411 B2
(45) Date of Patent: Aug. 14, 2012

(54) ORIENTATION-BASED WIRELESS SENSING APPARATUS

(76) Inventor: David A. Baker, Littleton, CO (US)

( * ) Notice: Subject to any disclaimer, the term of this patent is extended or adjusted under 35 U.S.C. 154(b) by 1024 days.

(21) Appl. No.: 12/154,641

(22) Filed: May 27, 2008

(65) Prior Publication Data

US 2009/0299550 A1 Dec. 3, 2009

(51) Int. Cl.
*G05D 1/00* (2006.01)

(52) U.S. Cl. ..... 701/2

(58) Field of Classification Search . 701/2; 342/357.21, 342/357.22, 357.25; 343/872, 878
See application file for complete search history.

(56) References Cited

U.S. PATENT DOCUMENTS

| | | | | |
|---|---|---|---|---|
| 6,339,397 | B1 * | 1/2002 | Baker | 342/357.64 |
| 7,450,083 | B1 * | 11/2008 | Baker | 343/873 |
| 8,006,574 | B2 * | 8/2011 | Meyer | 73/862.627 |
| 2009/0120208 | A1 * | 5/2009 | Meyer | 73/862.045 |

* cited by examiner

*Primary Examiner* — Faye M. Fleming
(74) *Attorney, Agent, or Firm* — Holland & Hart LLP

(57) ABSTRACT

An orientation-based wireless sensor includes a transmitter unit having a body housing a microprocessor, a transmitter, and an accelerometer for detecting the orientation of the transmitter unit relative to one-, two- or three-axis of the direction of the pull of earth's gravity. The transmitter body is mounted on a feature of a vehicle that it is desirable to monitor. The transmitter will transmit orientation data at predetermined time intervals to a receiver on the vehicle, which will in turn process the information, adding additional information, such as GPS location, and wirelessly send the data to a database that is available to a customer over the Internet.

15 Claims, 8 Drawing Sheets

ORIENTATION-BASED WIRELESS SENSING APPARATUS

CROSS-REFERENCES TO RELATED APPLICATIONS (Not applicable)

STATEMENT AS TO RIGHTS TO INVENTIONS MADE UNDER FEDERALLY SPONSORED RESEARCH AND DEVELOPMENT (Not Applicable)

INCORPORATION-BY-REFERENCE OF MATERIAL SUBMITTED ON A COMPACT DISC (Not applicable)

BACKGROUND OF THE INVENTION (1) Field of the Invention

The present invention relates generally to portable, self-contained vehicle tracking and monitoring systems, and more particularly to an improved orientation-based wireless sensing apparatus for sensing several conditions of a railcar or other vehicle using accelerometers.

(2) Description of Related Art Including Information Disclosed Under 37 CFR 1.97, 1.98

There are many problems and challenges for inventors to create a viable wireless sensing device for detecting a variety of different conditions of a vehicle or load using a single configuration of the device. Attempts have been made but no one has created a device to solve all of the problems.

First, the device must have low power requirements because railcars have no electrical power and the devices are subject to long-term use before being conveniently accessible to replace the power source.

The tracking unit must also be rugged and physically last a long time. Rail cars are constantly exposed to the elements, including salt spray, and are subjected to various shocks and vibrations during loading, sorting, and movement about the country.

Because there are many different types of conditions on a railcar that it is desirable to monitor, including: (1) whether the car is loaded or empty, (2) whether a hatch is open or closed, (3) whether a handbrake is set or released, (4) whether a door is open or closed, etc., it is important that the detectors have the ability to sense a variety of different motions or positions of critical vehicle features.

BRIEF SUMMARY OF THE INVENTION

It is therefore a general object of the present invention to provide an improved orientation-based sensing apparatus for railcars and the like.

A further object is to provide a sensing apparatus with discrete transmitters that are easily mounted to locations of interest on a railcar.

Yet another object of the present invention is to provide a sensing apparatus with low power consumption for sensing the position of designated components of a railcar.

These and other objects will be apparent to those skilled in the art.

The orientation-based sensing apparatus of the present invention includes a transmitter unit having a body housing a microprocessor, a transmitter, and one or more accelerometers sufficient to measure changes in the direction of the transmitter housing relative to gravity. The transmitter housing is mounted on an operable component of a feature of a vehicle for which it is desirable to monitor. The vehicle is preferably a railroad freight car, but may be any other similar type of vehicle. The transmitter will transmit orientation data at predetermined time intervals to a receiver on the vehicle, which will in turn process the information, add additional information such as GPS location, and wirelessly send the data to a database that is available to a customer over the Internet. A plurality of transmitters on the vehicle will monitor several features of the vehicle and periodically send transmissions to the receiver with the status of the monitored feature. The receiver includes a microprocessor with a database identifying the transmitters to be monitored, and may be powered down during the intervals between transmissions from the transmitters.

BRIEF DESCRIPTION OF THE SEVERAL VIEWS OF THE DRAWING

The preferred embodiment of the invention is illustrated in the accompanying drawings, in which similar or corresponding parts are identified with the same reference numeral throughout the several views, and in which.

DETAILED DESCRIPTION OF THE INVENTION

Figure 1:
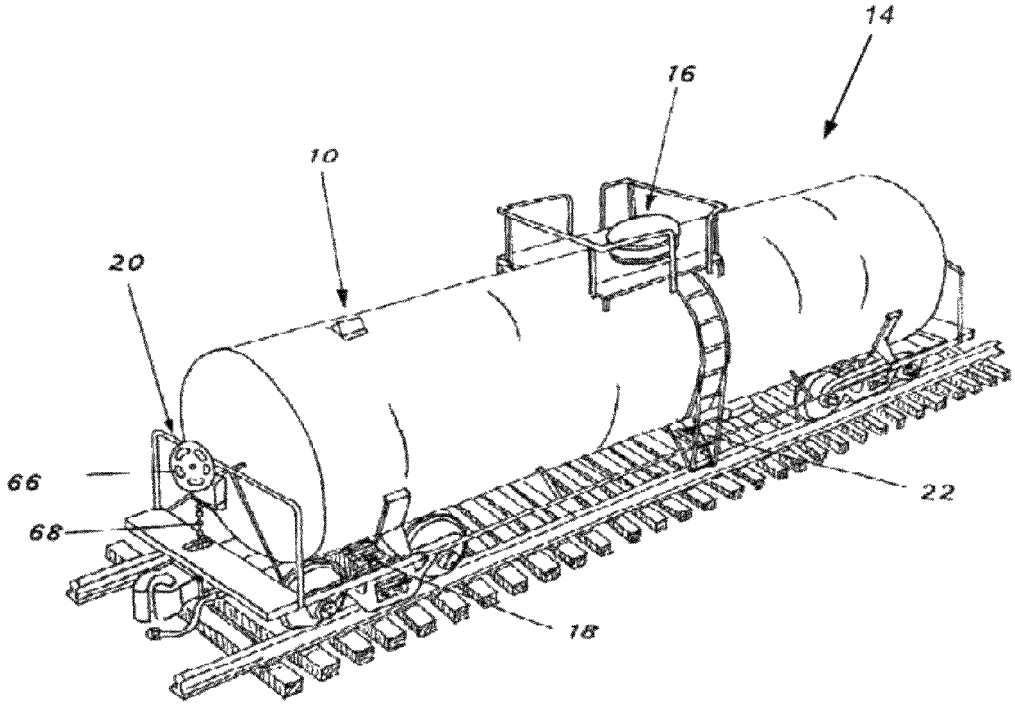
FIG. 1 is a perspective view of a railcar showing various features that it is desirable to sense or monitor, and a receiver unit of the sensing apparatus.

Referring now to the drawings, and more particularly to FIG. 1, the sensing apparatus of the present invention includes a single receiver/sender unit 10, and a plurality of standardized transmitter units 12 (one of which is shown in detail in FIG. 2) mounted on a railcar 14. Each transmitter unit 12 (not seen in FIG. 1), is positioned at a predetermined feature of railcar 14 to detect orientation of a component of that feature by sensing the direction of gravity using accelerometers. This orientation may thereby signify the fact that a change in conditions has occurred for that feature. In the preferred embodiment of the invention, the features to which a transmitter is operably attached include: hatch 16, bolster 18, hand brake 20 and security pin 22. Each of these features will be described in more detail hereinbelow.

Figure 2:
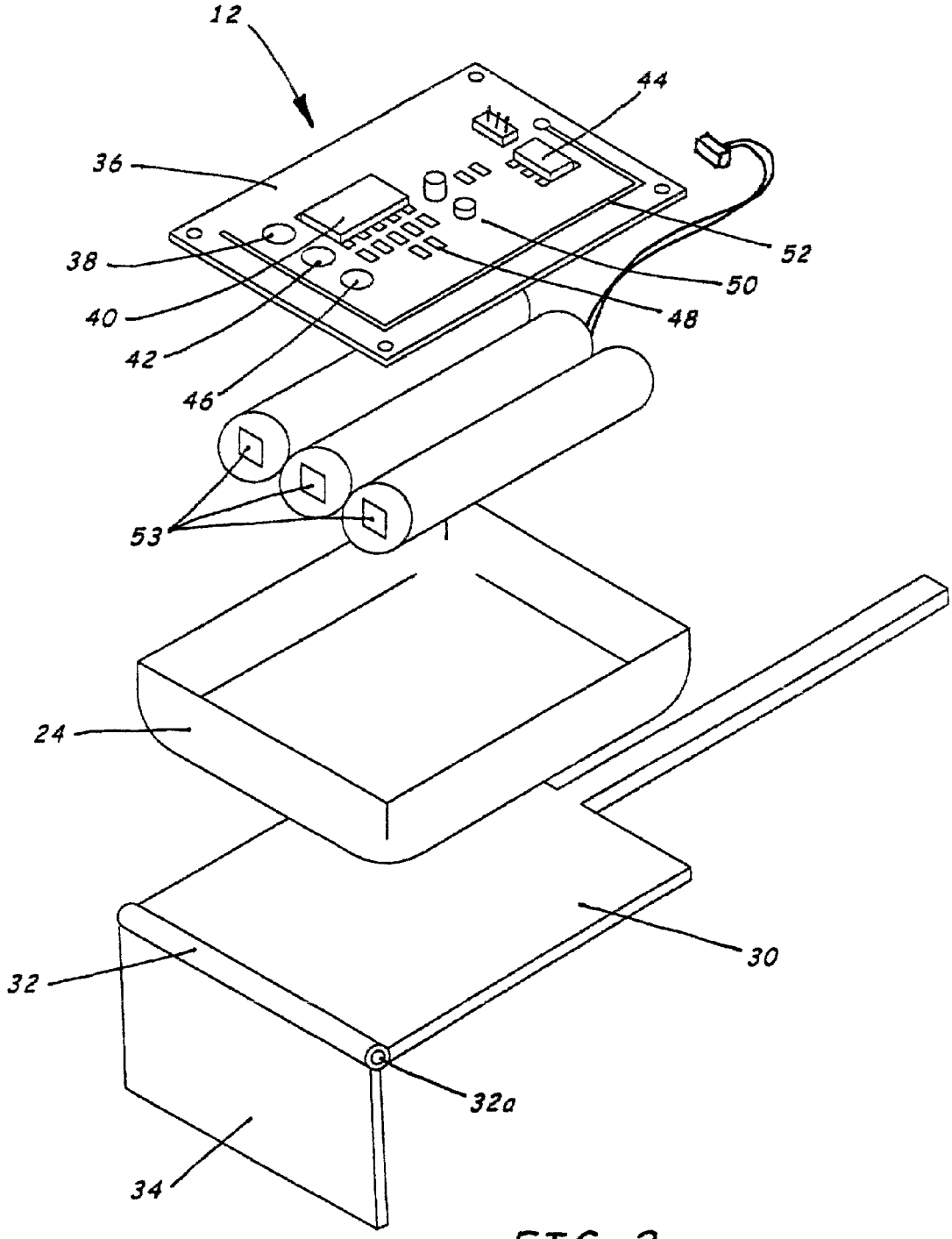
FIG. 2 is an exploded perspective view of one transmitter unit of the sensing apparatus.

Referring now to FIG. 2, one transmitter unit 12 of the present invention is shown in exploded form, to reveal more details. Transmitter 12 includes a hollow body 24, which serves as a mold for a potting compound such as polyurethane epoxy or other appropriate material to provide waterproofing and physical toughness. It should be noted that a hollow body such as that shown in the drawings is not necessary, and that the contents of the body may be encapsulated in a sealed enclosure or formed with a reusable mold.

A mounting plate 30 is fastened to the bottom of body 24 and includes a hinge 32 along one edge thereof. A hinge plate 34 is pivotally connected to hinge 32 for free pivotal movement about the axis of hinge pin 32*a* relative to mounting plate 30. While a hinge with a hinge pin is shown in detail in the drawings, any device with a pivotal connection (such as a living hinge or the like) could be substituted for the mechanical hinge described. A wand 26 extends outwardly coplanar with plate 30 and orthogonal to hinge 32 so that movement of extended wand 26 will pivot the entire body 24 with mounting plate 30 about pivot pin 32*a* of hinge 32.

A circuit board 36 is installed within body 24, and includes several features. First, circuit board 36 includes a short-range RF transmitter 38, preferably with a range of 100-1,000 feet. Circuit board 36 also includes a microprocessor 40 interconnected among the various electrical components of circuit board 36, to activate, monitor, control and communicate with each of the components. A variety of sensors may be incorporated in circuit board 36, including, but not limited to: (a) one, two or three mutually orthogonal accelerometers 44 to evaluate orientation of gravity relative to the body 24; (b) temperature sensor 46 (such as a thermister); (c) magnetic field detector 48 (such as a reed switch or Hall sensor); (d) battery voltage detector 50; etc. Finally, circuit board 36 includes an antenna trace or attached antenna element 52.

A primary power source, such as batteries 52, provides power to circuit board 36. Preferably, batteries 52 are of non-rechargeable varieties, such as those using lithium or alkaline chemistry. As noted above, each transmitter 12 is deployed on a particular feature to be monitored on railcar. For this purpose, the accelerometers 44 may be of any known type, but are preferably low-range accelerometers having a range of at least +/−1 G. The accelerometer of choice utilizes MEMS technology, as it can measure a steady-state acceleration and not just changes in acceleration. It should be noted that this may be accomplished using one, two or three accelerometers, depending upon the orientation of the transmitter and the rotational movement that is being monitored. Thus a 3-axis accelerometer is the most flexible in that it will detect the orientation of the transmitter, no matter the orientation of the transmitter. A 2-axis accelerometer is ideal in that it is less expensive and consumes less power than a 3-axis accelerometer. A two axis accelerometer will detect changes in the gravity component measurements regardless of its orientation if the axis of rotation is other than vertical. Therefore, the third axis of the 3-axis accelerometer is not mandatory. For this reason, only two orthogonal axis of the direction of gravity need be detected. Finally, if the transmitter is oriented to merely detect a tilt angle, then a single axis accelerometer is all that is needed. As noted above, in the preferred embodiment, a single, two-axis MEMS accelerometer is used. However, other combinations may also be used to determine all three axis. For example, a combination of two single-axis accelerometers, with each axis mutually orthogonal, may be used in place of a single 2-axis accelerometer. Thus, accelerometers 44 may be installed so as to detect pertinent orientation of an associated physical component, as will be described in more detail with respect to each railcar feature.

Each transmitter 12 is a small self-contained battery-powered device that is deployed on a feature of a railcar and which "awakens" at periodic intervals to read the condition of the particular component to which it is attached, and transmits that sensor data to receiver 10, along with "housekeeping" data. Each transmitter 12 transmits a unique ID number with each transmission so that the receiver 10 can reference an internal database to determine if the transmitter 12 belongs to that particular receiver 10. This prevents multiple receivers 10 from gathering the same data from a given transmitter 12, in the event that multiple railcars are within transmitting range of one another.

Figure 3:
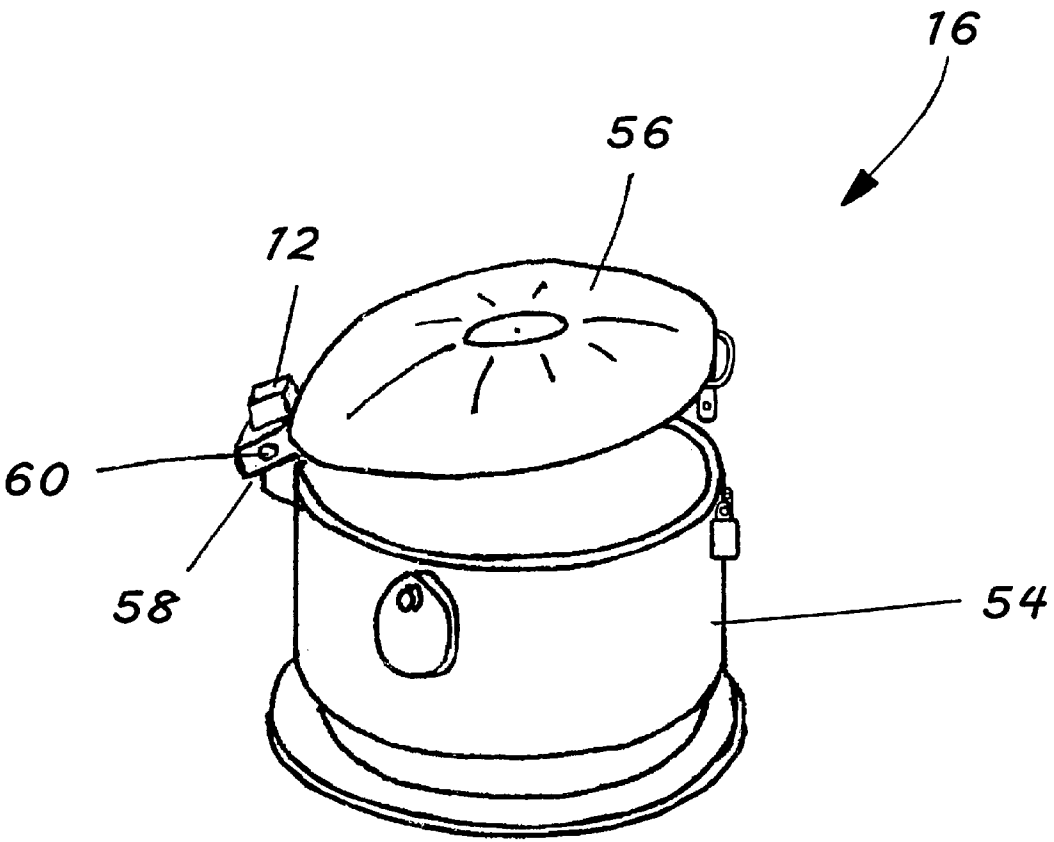
FIG. 3 is a perspective view of a railcar hatch with a transmitter mounted in a location to detect the position of the hatch.

Referring now to FIG. 3, a typical hatch 16 on a railcar 14 is shown in more detail. Hatch 16 includes a generally cylindrical access passage 54 with a lid 56 pivotally mounted to passage 54 on hinge 58. Hinge 58 has a generally horizontally oriented hinge pin 60, such that lid 56 will pivot in a vertical plane orthogonal to the axis of hinge pin 60. A transmitter 12 is mounted to the pivoting lid 56 adjacent hinge 58, such that movement of lid 56 will also move transmitter 12 about the rotational axis of hinge pin 60, and in an angular direction relative to the direction of gravity. Thus the accelerometer 44 within transmitter 12 will detect the orientation of the transmitter 12 and lid 56, thereby monitoring the position of lid 56 as it is moved between open and closed positions. This information is then transmitted to receiver 10 (FIG. 1).

Figure 4:
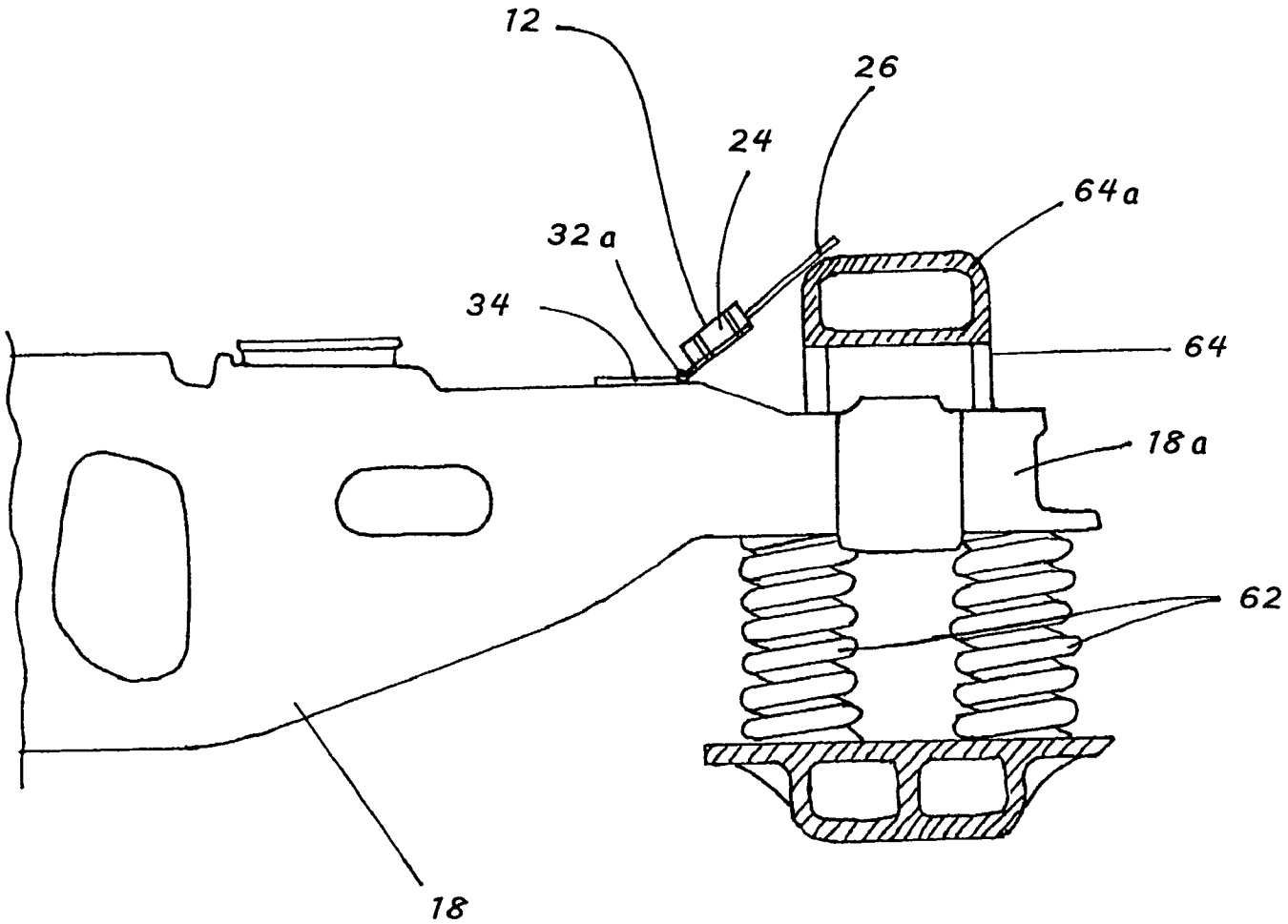
FIG. 4 is an elevational view of a railcar bolster with a transmitter mounted in a location to detect whether the railcar is loaded or empty.

Referring now to FIG. 4, a portion of bolster 18 is shown in more detail. One end 18*a* of bolster 18 is supported on compression springs 62, which are mounted within side frame 64 of a wheelset. As a load is added to the railcar, bolster 18 will depress springs 62 and move downward relative to the upper member 64*a* of side frame 64. Transmitter 12 is connected between bolster 18 and upper member 64*a* of side frame 64 to detect the position of the bolster 18 relative to sideframe upper member 64*a*. In this case, the hinge plate 34 is mounted to bolster 18, so that transmitter body 24 will pivot about hinge pin 32*a*. The end of tube 26 extends outwardly from body 24 and directly contacts the top of bolster sideframe upper member 64*a*. It can be seen that when the railcar 14 is loaded, bolster 18 will compress springs 62 and lower the bolster relative to sideframe upper member 64*a*. This downward relative position translates as a rotational movement of tube 26 and thereby moves transmitter 12 to a more vertical position relative to gravity. Accelerometer 44 will measure the tilt angle, and hence the amount of downward movement of the bolster 18, which is directly proportional to the load that is added (or removed) from the railcar.

Figure 5:
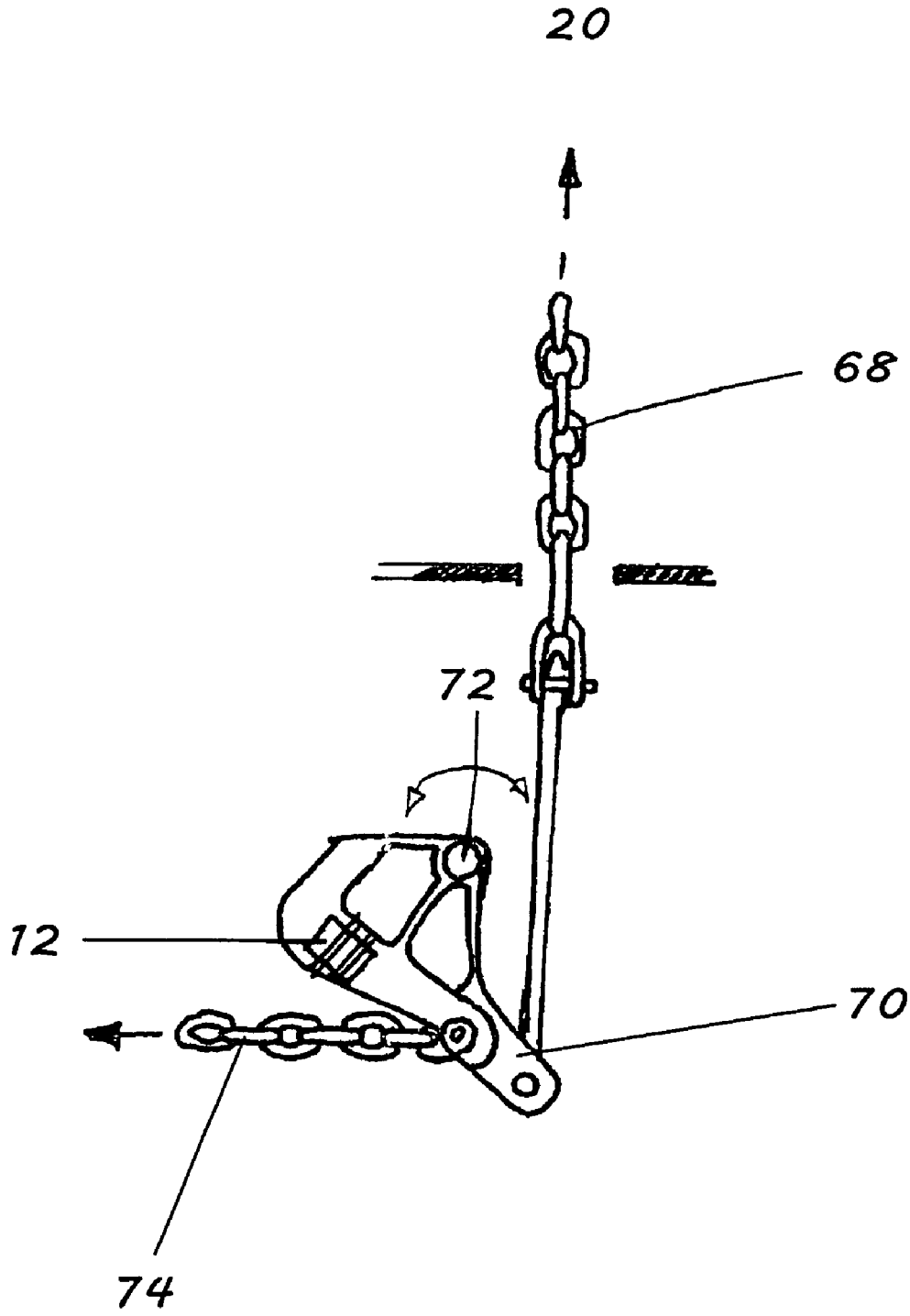
FIG. 5 is an elevational view of a railcar bell crank of a brake system with a transmitter mounted in a location to detect whether the brake is on or off.

Referring once again to FIG. 1, hand brake 20 is a conventional type of brake with a rotatable brake wheel 66 connected to a chain 68, which wraps, or unwraps from the axle of the wheel 66 to apply or release the brake. FIG. 5 is a detailed drawing of the connection of the chain 68 extending from wheel 66 (in FIG. 1), to the bell crank 70. Bell crank 70 pivots about pin 72, to draw brake chain 74 in a horizontal direction, thereby applying (or releasing) the brake. A transmitter 12 is directly mounted to bell crank 70, as shown in FIG. 5, to detect the rotating bell crank's orientation relative to the direction of earth's gravity. In this way, transmitter 12 can detect whether hand brake 20 is applied or released, and transmit this information to receiver 10 (FIG. 1).

Figure 6:
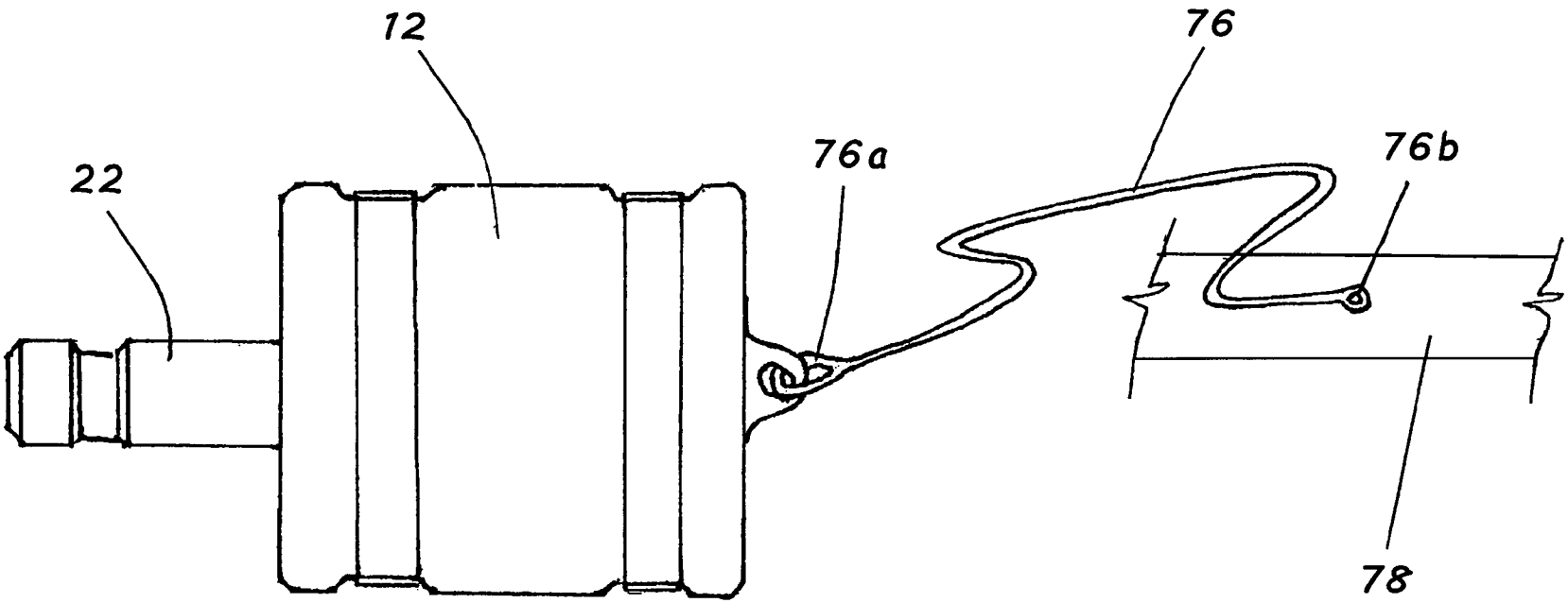
FIG. 6 is an elevational view of a transmitter connected to a security pin, to detect whether the pin has been removed from the secured position on the railcar.

Referring now to FIG. 6, a transmitter 12 is shown mounted to one end of a security pin 22. Pin 22 is of a type that is positioned horizontally in order to secure a desired member in position. A lanyard 76 is secured at one end 76*a* to a horizontal end of transmitter 12, and secured at the other end 76*b* to an adjacent frame 78 of the railcar 14 (shown in FIG. 1). It can be seen that, when pin 22 is removed from its secured position, it will drop and swing from lanyard 76. Because lanyard 76 is secured to a horizontal end of transmitter 12, it will re-orient the transmitter with the horizontal end in a vertical position. This orientation is detected by the accelerometer 44 within transmitter 12, and transmitted to receiver 10.

Figure 7:
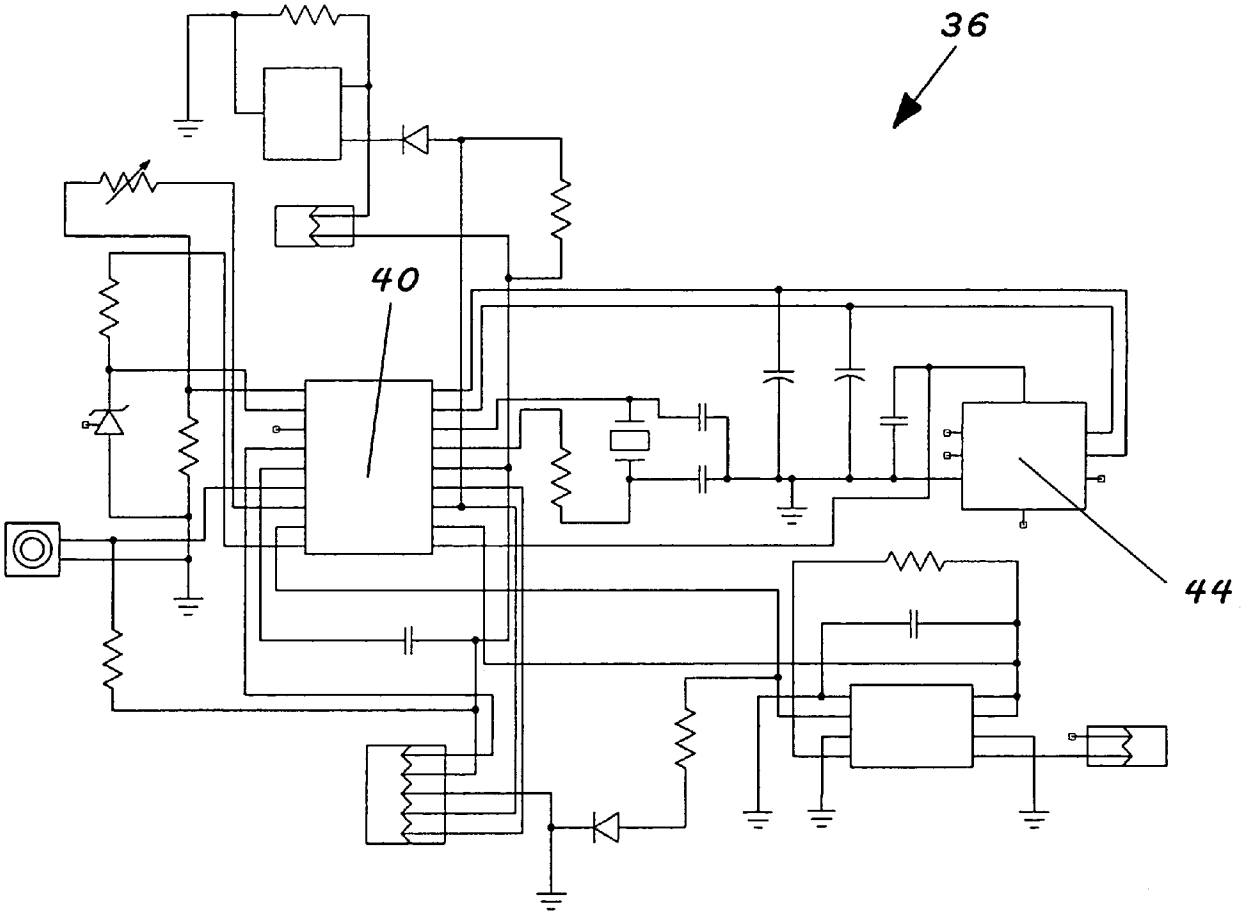
FIG. 7 is a circuit diagram of one embodiment of the transmitter.

FIG. 7 is provided to present one embodiment of a circuit diagram for the circuit board 36 of transmitter 12.

Referring once again to FIG. 1, receiver 10 is positioned on railcar 14 in any convenient location. Receiver 10 is a device capable of receiving data from a plurality of transmitters 12, adding additional data such as GPS location, time, other sensor data and housekeeping data, and sending that data through a secondary wide-area network such as GSM/GPRS, satellite, Wi-Fi or other means that will move the data on to the Internet for reception at a server computer.

Figure 8:
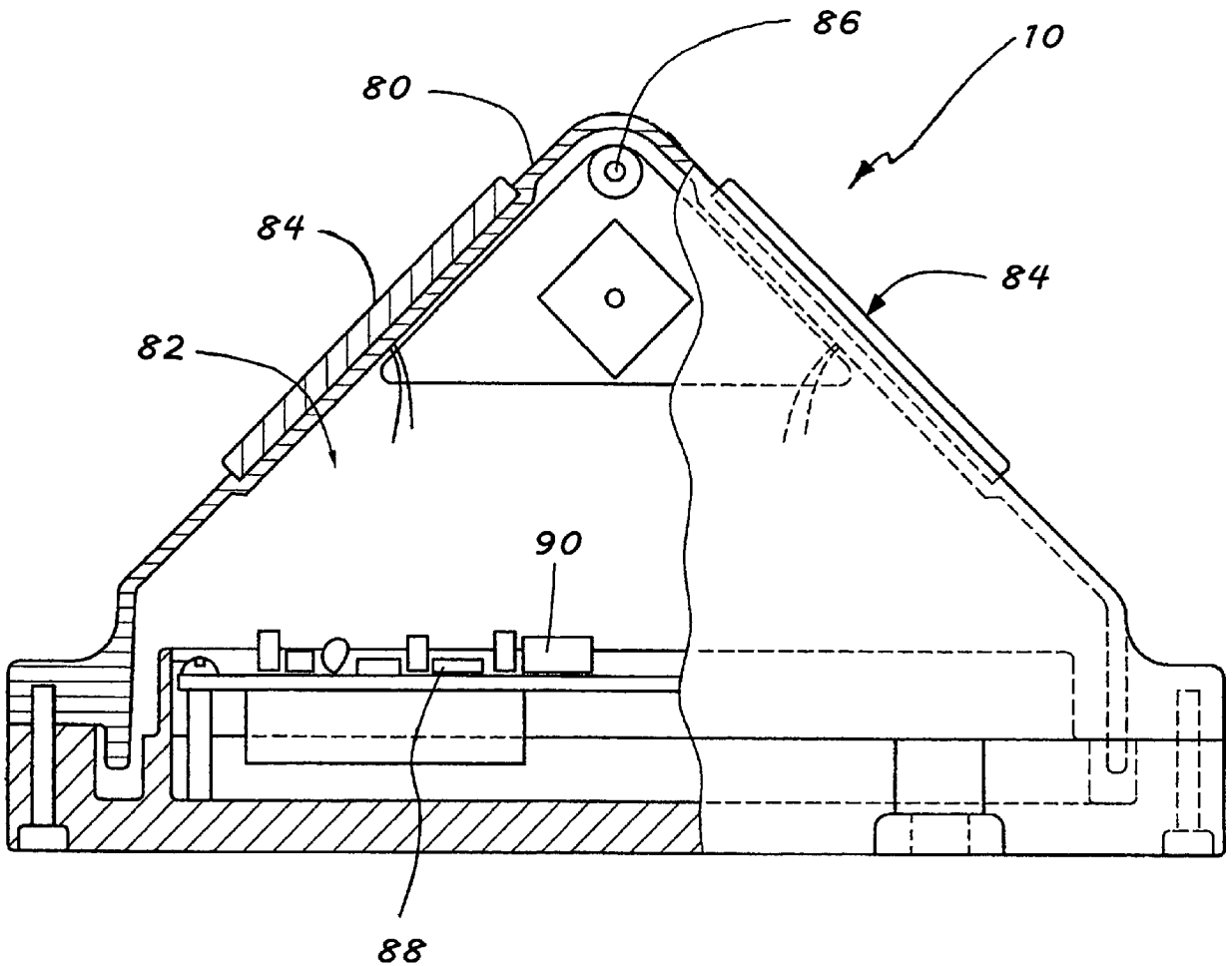
FIG. 8 is a cross-sectional view through a receiver of the invention.

FIG. 8 is a cross-sectional view through a base receiver 10 of the present invention. Receiver 10 includes a hollow housing 80 which may be triangular in cross-sectional shape, with an interior cavity 82 large enough to enclose the various electronic components of the receiver. A pair of solar panels 84 are mounted to the surfaces of housing 80, to provide electrical power to the receiver 10. In the preferred embodiment of the invention, housing 80 is formed of a material that is RF transparent, to permit electronic transmissions to pass through the housing. An antenna 86 is mounted within the interior cavity 82, and preferably in the upper apex of the housing 80.

A microprocessor 88 receives various data and signals from receiver circuitry 90, and is powered by batteries which are charged from the solar panels 84. Receiver circuitry 90 includes a GPS receiver for receiving tracking information from various satellites of the GPS. This data is transmitted in digital form from the GPS receiver to the microprocessor 88. Data from the GPS is processed by the microprocessor 88 and formatted as a data packet. As noted above, the receiver 10 will also receive data from the various transmitters 12 and identify each transmitter 12 from a database in the microprocessor 88. Upon receipt of data from transmitters 12, receiver 10 will check the data packet for errors and add other data available to the receiver (such as GPS location and accurate time stamp). Receiver 10 will then use a wireless Internet connection to transmit the data to a web-site/database facility for customer access via the Internet.

Referring again to FIG. 2, each transmitter 12 is designed to transmit a time between transmissions, so that the receiver 10 can enter this information in the database and know the time interval to the next transmission. In general, the time interval between transmissions is fixed, but this is not required. This time interval between transmissions allows the receiver 10 to save power by only powering its RF receiver during expected transmission windows of the various transmitters 12.

Each transmitter 12 will remain in a low-power state, running a Real Time Clock (RTC) only until a "wake-up": time interval is reached. At that time, it will bring the processor out of sleep mode. Once out of sleep mode, the transmitter 12 will gather all sensor data, build a data packet, and transmit the data packet to the base receiver 10. Transmitters 10 may gather sensor data at times other than transmission times, and may send maximum and minimum values and/or a string of multiple readings gathered between transmission times.

As shown in the circuit diagram of FIG. 7, significant battery life can be achieved by implementing a power design wherein the microprocessor actively maintains a minimum operating voltage, and therefore a minimum operating current. This is achieved by having the microprocessor switch in and out a MOSFET switch that bypasses a power lead supplied via a voltage-dropping resistor. When the MOSFET switch is open, power is fed via a resistor along the power lead, to present a lower voltage to the microprocessor. As the battery discharges and outputs a lower voltage, the MOSFET switch is closed to bypass the resistor feed-path and provide a direct connection between battery and microprocessor.

Whereas the invention has been shown and described in connection with the preferred embodiments thereof, many modifications, substitutions and additions may be made which are within the intended broad scope of the appended claims.

What is claimed is:

1. An orientation-based wireless sensing apparatus, comprising:

a body formed of material invisible to RF transmissions and mounted on a component desired to be monitored for its orientation relative to earth's gravitational pull (the direction of gravity);

an accelerometer within the body for measuring relative to at least a first axis of the direction of gravity;

a microprocessor within the body and connected to the accelerometer;

a transmitter within the body and connected to the microprocessor;

a power source within the body and connected to the accelerometer, microprocessor and transmitter; and an antenna mounted within the body and connected to the transmitter.

2. The sensing apparatus of claim 1, wherein said accelerometer includes means for measuring along a second axis of the direction of gravity, orthogonal to the first axis.

3. The sensing apparatus of claim 2, wherein said accelerometer includes means for measuring along a third axis of the direction of gravity, orthogonal to the first and second axis.

4. The sensing apparatus of claim 3, wherein said accelerometer includes a first two-axis accelerometer and a second single-axis accelerometer, the measuring axes of the first and second accelerometers all being orthogonal, to measure three distinct axis of acceleration relating to the direction of gravity.

5. The sensing apparatus of claim 3, further comprising:

a mounting plate attached to a lower wall of the body and having a first side edge; a hinge plate pivotally connected along the first side edge of the mounting plate by a hinge.

6. In combination:

a vehicle having at least one operable feature that it is desired to monitor, the operable feature including at least one component that moves between first and second positions; and an orientation-based wireless sensing apparatus mounted on the vehicle and positioned to monitor the operable feature and transmit a physical orientation of the component relative to earth's direction of gravity, thereby indicating a position of the component, comprising:

a receiver unit mounted on the vehicle and operable to receive transmitted data packets from at least one transmitter unit on the vehicle and to wirelessly transmit data packets to a remote database for storage and further processing and transmission; and a transmitter unit mounted on the component and including:

a body attached to the component and formed of material invisible to RF transmissions;

an accelerometer within the body for measuring relative to at least a first axis of the direction of gravity;

a microprocessor within the body and connected to the accelerometer;

a transmitter within the body and connected to the microprocessor;

a power source within the body and connected to the accelerometer, microprocessor and transmitter; and an antenna mounted within the housing body and connected to the transmitter;

said microprocessor operable to receive orientation data relative to the component from the accelerometer, process the information, and transmit the processed information as a data packet through the transmitter to the receiver unit.

7. The combination of claim 6, wherein the operable feature includes a door operable between open and closed positions, and wherein said transmitter unit is mounted on said door.

8. The combination of claim 6, wherein the operable feature is a hand brake, wherein said component is a bell crank operably interposed in the handbrake, and wherein said transmitter unit is mounted on said bell crank.

9. The combination of claim 6, wherein said transmitter unit further includes:

a mounting plate attached to a lower wall of the body, the mounting plate having a first side edge;

a hinge plate pivotally connected along the first side edge of the mounting plate by a hinge.

10. The combination of claim 9:

wherein the operable feature is a wheelset of the vehicle having compression springs supporting one end of a bolster;

wherein said wheelset has a sideframe which does not move relative to the compression of the springs and the bolster supported on those springs;

wherein the component is the bolster end supported on the springs, movable between a lower compressed position when the vehicle is loaded, and an upper uncompressed position when the vehicle is not loaded;

wherein said transmitter unit hinge plate is secured to the bolster end and a portion of the mounting plate is operably supported on the wheelset sideframe, said transmitter unit positioned such that movement of the bolster end between the upper and lower positions will cause a change of orientation of the transmitter body, which is measured by the accelerometer as a change in angle of orientation relative to the direction of gravity.

11. The combination of claim 6, further comprising circuitry connected between the transmitter power supply and the microprocessor to maintain a minimum operating voltage and minimum operating current.

12. The combination of claim 11, wherein said circuitry includes:

an electrical lead between the power supply and the microprocessor, said lead having a voltage dropping resistor interposed therein to present a lower voltage to the microprocessor therefore causing the microprocessor to consume less current;

a bypass lead electrically connecting the power supply and the microprocessor and bypassing the resistor;

a switch operable between open and closed positions and interposed in the bypass lead; and said switch including means for detecting the voltage in the electrical lead and operable to closed the switch when the voltage drops to a predetermined value.

13. The combination of claim 6, wherein the transmitter is programmed to transmit data packets at predetermined time intervals, and wherein the microprocessor in the receiver unit is programmed to power up the receiver at the predetermined intervals of transmission from the transmitter, and power down the receiver between those predetermined intervals.

14. In combination:

a vehicle having a plurality of operable features that it is desired to monitor, each operable feature including at least one component that moves between first and second positions; and an orientation-based wireless sensing apparatus mounted on the vehicle and operable to monitor the operable features and transmit a physical orientation of each component relative to the first and second positions, comprising:

a single receiver unit mounted on the vehicle and operable to receive transmitted data packets from a plurality of transmitter units on the vehicle and to wirelessly transmit data packets to a remote database for storage and further processing and transmission; and a plurality of transmitter units mounted on the vehicle, one transmitter unit mounted on each operable component of each monitored feature, each transmitter unit including:

a body attached to the component and formed of material invisible to RF transmissions;

an accelerometer within the body for measuring relative to at least a first axis of the direction of gravity, to thereby determine the orientation of the component;

a microprocessor within the body and connected to the accelerometer;

a transmitter within the body and connected to the microprocessor;

a power source within the body and connected to the accelerometer, microprocessor and transmitter; and an antenna mounted within the body and connected to the transmitter;

said microprocessor operable to receive orientation data relative to the component from the accelerometer, process the information, and transmit the processed information as a data packet through the transmitter to the receiver unit;

each transmitter unit having a unique identification code associated therewith, and each transmitter microprocessor programmed to transmit the identification code as part of the data packet transmitted to the receiver unit; and said receiver unit microprocessor including a database of the identification codes of each of the transmitter units on the vehicle, and operable to monitor and process only those data packets received from designated transmitters.

15. The combination of claim 14, wherein each transmitter is programmed to transmit data packets at predetermined time intervals, and wherein the microprocessor in the receiver unit is programmed to power up the receiver at the predetermined intervals of each of the transmitters, and power down the receiver between those predetermined intervals.

* * * * *